US005826737A

United States Patent [19]

Zakensberg

[11] Patent Number: 5,826,737

[45] Date of Patent: Oct. 27, 1998

[54] THERMOFORMED RECLOSABLE CONTAINER

[75] Inventor: Issac Zakensberg, Scotch Plains, N.J.

[73] Assignee: Colgate-Palmolive Company, New York, N.Y.

[21] Appl. No.: 795,490

[22] Filed: Feb. 5, 1997

Related U.S. Application Data

[60] Provisional application No. 60/011,853, Feb. 20, 1996.

[51] Int. Cl.[6] ..... B65D 1/02

[52] U.S. Cl. ..... 215/47; 215/236; 215/253; 220/336; 222/153.06; 222/541.6; 383/62; 206/484; 206/469

[58] Field of Search ..... 215/253, 47, 236, 215/383, 906, 203, 207–209, 62, 63; 383/906, 203, 207–209, 62, 63; 220/336; 206/484, 529, 530, 469, 470; 222/541.6, 153.06

[56] References Cited

U.S. PATENT DOCUMENTS

| | | | |
|---|---|---|---|
| 3,117,703 | 1/1964 | Henchert | 220/258 X |
| 3,184,149 | 5/1965 | Repko | 383/203 |
| 3,278,085 | 10/1966 | Brown . | |
| 3,352,445 | 11/1967 | Cochin | 220/336 X |
| 3,355,058 | 11/1967 | Asbury | 222/541.6 X |
| 3,388,789 | 6/1968 | Simandl et al. | 383/203 |
| 3,419,181 | 12/1968 | Stec | 220/258 |
| 3,458,080 | 7/1969 | Laurizio | 220/258 |
| 3,727,829 | 4/1973 | Huni | 383/203 |
| 3,815,810 | 6/1974 | Wellman | 383/906 X |
| 3,913,734 | 10/1975 | Siegel . | |
| 4,209,096 | 6/1980 | Carkhuff . | |
| 4,458,818 | 7/1984 | Hansen | 215/47 |
| 4,724,979 | 2/1988 | Cleevely et al. | 220/258 |
| 4,727,999 | 3/1988 | Gach | 220/258 X |
| 4,786,190 | 11/1988 | Van Erden et al. | 383/207 X |
| 4,880,137 | 11/1989 | Wells | 220/258 X |
| 4,974,732 | 12/1990 | Sullivan et al. | 222/541.6 |
| 5,148,935 | 9/1992 | Lyon | 220/258 X |
| 5,228,782 | 7/1993 | Imer . | |
| 5,417,495 | 5/1995 | Branson | 383/63 |
| 5,529,224 | 6/1996 | Chan et al. . | |

FOREIGN PATENT DOCUMENTS

| | | |
|---|---|---|
| 0148118 | 7/1985 | European Pat. Off. . |
| 0 701 953 A1 | 3/1996 | European Pat. Off. . |
| 6412002 | 4/1966 | Netherlands . |

*Primary Examiner*—Stephen K. Cronin
*Assistant Examiner*—Robin A. Hylton
*Attorney, Agent, or Firm*—Michael McGreal

[57] ABSTRACT

A recloseable container is preferably produced by thermo60 forming. The container has an elongated shape with a dispensing nozzle at one end. Above the dispensing nozzle is a tab. When this tab is broken off the container, the nozzle is opened. Adjacent the nozzle is a hinged closure. The hinged closure has a shape complementary to that of the nozzle and can be rotated on the hinge to overlap and close the container nozzle. There is an arrangement to lock the closure in a nozzle closing orientation and an arrangement to provide an air and liquid seal to the nozzle.

17 Claims, 1 Drawing Sheet

THERMOFORMED RECLOSABLE CONTAINER

This application claims the benefit of U.S. Provisional application Ser. No. 60/011,853 filed Feb. 20, 1996.

FIELD OF THE INVENTION

This invention relates to recloseable container, and more particularly, to a recloseable thermoformed dispensing tube-like container.

BACKGROUND OF THE INVENTION

There is a need for containers for smaller amounts of products. When the contents of the container are to be delivered in a single dose, there is no need for a recloseable feature. A part of the container can be permanently removed such as by cutting away a part of the container to open it, or by breaking away a part of the container at a weakened point. After opening, the full contents of the container are used.

The typical small container that is to be reclosed is a small tube or bottle. These containers will have a threaded or a hinged closure to close the opening of the container. Typical of these containers are small or sample sized lotion bottles and tubes such as those used for dentifrices and for medications. These are multi-component packages which are more costly to manufacture. They include a container plus a closure.

The present recloseable container is a one-piece thermoformed container. It is produced in the packaging line at the time of filling. The container consists of a base portion and an overlying top portion. The base portion is thermoform molded and placed on the filling line. It is filled with the product and the top portion thermoform molded and placed over the filled base portion. The base portion and the top portion then are adhesively or heat sealed, one to the other, at a border periphery. Thermoformed containers of this type are presently in use. However, none of these containers has an effective reclosing feature that is an integral part of the thermoformed container. There is a cost saving when the recloseable feature is an integral part of the container. The total package cost is less, there is no need to inventory packaging components, and there is no assembly cost.

The prior art with regard to recloseable thermoformed containers is described in U.S. Pat. No. 3,278,085; U.S. Pat. No. 3,913,734; U.S. Pat. No. 4,209,096 and U.S. Pat. No. 5,228,782. U.S. Pat. No. 3,278,085 discloses a sachet container that is opened by removing a tear-off portion to open a nozzle. The nozzle is closed by folding over the top part of the nozzle with the folded portion held by two locking tabs.

In U.S. Pat. No. 3,913,734, the container is of the blister pack type with the backing board having a memory of its original position. The nozzle of the container is opened by bending backward the backing board. When some of the contents have been dispensed, the backing board regains its original shape closing the container. This container is improved upon in U.S. Pat. No. 4, 209,096. In this patent, there is added a securing means to assuring that the backing board acquires its original position and retains its original position.

U.S. Pat. No. 5,228,782 discloses another fold-over type of recloseable sachet. The nozzle is opened by the removal of a tear-off tab. The sachet is closed and locked by folding over the nozzle at an angle and inserting the end of the nozzle into a holding slit. A locking technique of using an interfitting projection and aperture is disclosed in EP 18,118A. This can be used to secure a folded over portion to a main portion of a container.

None of these references discloses an effective recloseable feature for a thermoformed container.

BRIEF SUMMARY OF THE INVENTION

The present invention is directed to a recloseable container, and preferably a recloseable thermoformed container. The container preferably is of an elongated shape, and most preferably an elongated tube-like shape. The container has a surrounding planar border and at the upper end a dispensing means which preferably is in the shape of a nozzle. Coupled with the dispensing means is a removable tab portion which when removed opens the dispensing means. Adjacent the dispensing means is a closure which is hingedly attached to the border of the dispensing means. This closure rotates on the hinge to overlay and to close the dispensing means after a dispensing operation. Associated with the closure is a locking means to lock the closure into a sealing engagement with the dispensing means. This locking means in one embodiment is a mating pin and aperture arrangement.

Optionally, a part of the closure is a further seal to provide an air and liquid tight seal. In a preferred embodiment, this comprises an interfitting rib and groove arrangement on the closure and on the dispensing means. The rib or groove may be carried by either the closure or the dispensing means.

The thermoformed container is made in two parts. There is a base portion and a top portion. Each is separately formed and adhesively or heat bonded at the border of the two portions to form a container. Prior to the top portion being bonded to the base portion, the product is filled into the base portion. The forming and filling of the container can be accomplished on a continuous form/fill line. The base portion is thermoformed and filled and overlaid by the top portion. The two portions then are bonded together to form the filled container.

The result is a low cost recloseable dispensing container. It is a one-piece container. Further, it is particularly adapted for use on form/fill packaging lines.

DETAILED DESCRIPTION OF THE INVENTION

Figure 1:
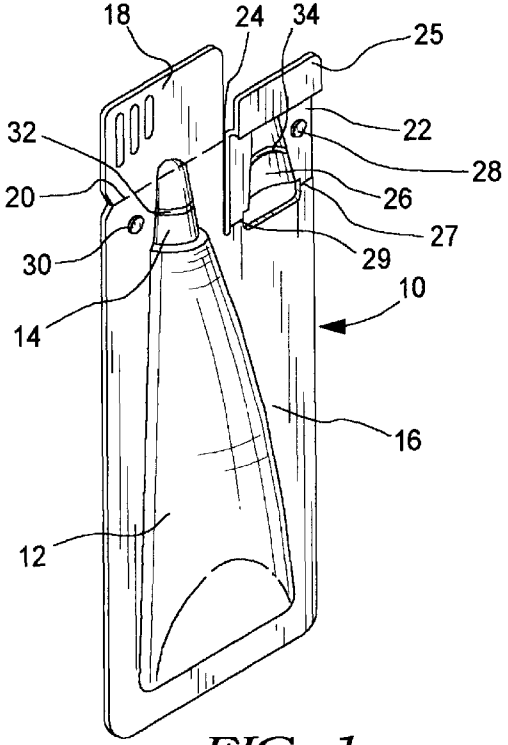
FIG. 1 is a perspective view of the container in a filled and unopened condition.

The recloseable container will be described with reference to the drawings. FIG. 1 shows the recloseable container in a filled and sealed condition. This is the condition in which the consumer will find the container on a store shelf.

The container 10 is comprised of elongated section 12 which holds the product to be dispensed. On the upper end of this elongated section is a dispensing nozzle 14. Surrounding the elongated section and the dispensing nozzle is a border 16. It is at this border 16 that a base portion and a top portion are bonded together. The base portion and the top portion preferably are thermoformed and the two portions heat or adhesively bonded together.

Adjacent to the dispensing nozzle 14 is a breakaway tab 18. This breakaway tab separates from the container 10 at a weakened score line 20. By the removal of this breakaway tab 18, the end of the dispensing nozzle 14 is removed and thus the dispensing nozzle opened.

Sidewise adjacent to the dispensing nozzle 14 is hinged closure 22. Hinge 24 attaches this closure 22 to the border 16. Tab 25 is a grip tab to facilitate the movement of this closure. Located on this closure is locking aperture 28 which mates with locking pin 30 on the border 16 on the opposite side of the dispensing nozzle. In addition, in a further embodiment, there is seal groove 34 on the portion 16 of the dosure that is to overlay the dispensing nozzle 14. A seal rib 32 on the dispensing nozzle will interfit into this groove 34.

Figure 2:
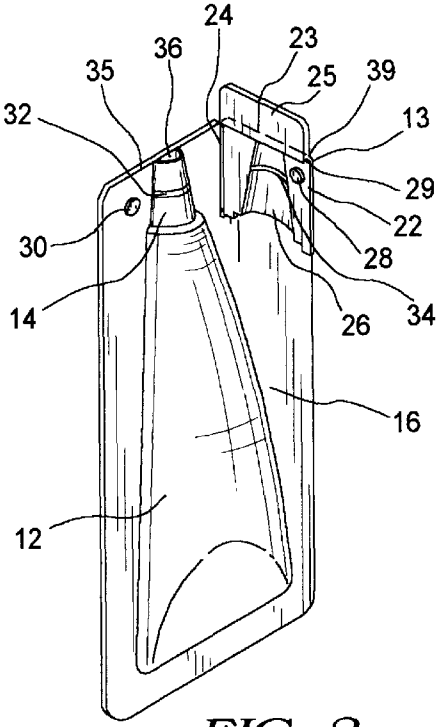
FIG. 2 is a perspective view of the container with the dispensing means opened.
Figure 3:
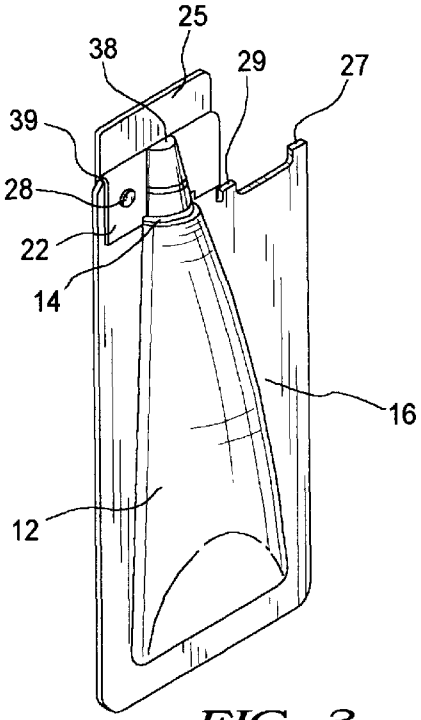
FIG. 3 is a perspective view of the container with the closure closing the dispensing means.

In FIG. 2, the container 10 is shown with the breakaway tab 18 removed. This creates nozzle opening 36. Also shown in this figure is the hinged closure 22 partially rotated in the process of closing the nozzle opening. This is rotated by breaking attachments at 27 and 29. Also shown in this view is the closure latching mechanism. This consists of groove 39 on the hinged closure and edge 35 on the container. The hinged closure 22 has an upper portion and a lower portion with these portions offset one from the other by the groove 29. When fully closed edge 35 will fit into groove 39. Dotted line 23 shows the top of the groove 39 in this view. In FIG. 3, the container is shown as fully closed with the closure fully rotated to overlap over dispensing nozzle 14. Aperture 28 and pin 30 are in a locked position and rib 32 is seated in groove 34.

Figure 4:
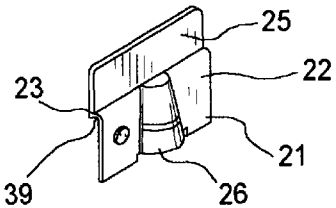
FIG. 4 is a cut-away view of the closure latching mechanism.

In FIG. 4, the latching mechanism is shown in more detail. The latching groove 39 is in the transition from the lower part 21 of the hinged closure 22 and tab 25. Ridge 23 is the uppermost part of latching groove 39. When the hinged closure is rotated to close the nozzle, edge 35 of the container locks into groove 39 to hold the closure 22 in place over the dispensing nozzle 14.

As noted, the container preferably is made by thermoforming. In this process, the top portion and base portion are separately thermoform molded. The base portion is filled with a product and the top portion overlaid onto the bottom portion. They then are heat or adhesively bonded one to the other.

The container can be made from essentially any thermoformable materials. Essentially, any thermoplastic can be used. These include polystyrene, polyethylene terephthalate, polyethylene, polypropylene, ethylene and propylene copolymers, vinyl polymers and copolymers, and vinylidene copolymers.

I claim:

1. A reclosable container comprising a container body, a planar border at least partially surrounding said container body said container body sealed at one end and having an openable dispensing means at another end; a first breakaway means disposed above said dispensing means and closing said dispensing means; a hinged closure means laterally adjacent said dispensing means and attached to said container body by a hinge, said hinged closure means having an upper portion and a lower portion, said upper portion offset from said lower portion and connected to said lower portion by a lateral groove, said hinged closure means rotating on said hinge to overlap and reclose said dispensing means after said first breakaway means has been removed.

2. A reclosable container as in claim 1 wherein said container is a thermoformed container.

3. A recloseable container as in claim 1 wherein said hinged closure means has a section with a shape complementary to that of said dispensing means.

4. A reclosable container as in claim 1 wherein said hinged closure means additionally is attached to said container body by a second breakaway means whereby after severing said second breakaway means said hinged closure means is able to be rotated on said hinge to close said dispensing means.

5. A recloseable container as in claim 1 wherein said dispensing means and said hinged closure means have cooperating liquid seal means.

6. A recloseable container as in claim 5 wherein said cooperating liquid seal means comprises an interfitting rib and groove arrangement.

7. A reclosable container comprising a container body sealed at one end and having an openable dispensing means at another end; a planar border at least partially surrounding said container body, a first breakaway means disposed above said dispensing means and closing said dispensing means; a hinged closure means laterally adjacent said dispensing means and attached to said planar border by a hinge, said hinged closure means rotating on said hinge to overlap and close said dispensing means after said first breakaway means has been removed, and a lateral groove on said hinged closure such that when such hinged closure means is rotated to reclose said dispensing means a portion of said planar border enters into said lateral groove to latch said hinged closure.

8. A recloseable container as in claim 7 wherein said hinged closure means has a section with a shape complementary to that of said dispensing means.

9. A recloseable container as in claim 7 wherein said hinged closure means has a locking means to lock said hinged closure means to close said dispensing means.

10. A recloseable container as in claim 9 wherein there is a planar border surrounding said container body, said border has a locking means to accept the locking means of said hinged closure means.

11. A recloseable container as in claim 10 wherein said border locking means and said hinged closure locking means comprise a mating pin and aperture.

12. A recloseable container as in claim 7 wherein said container is a thermoformed container.

13. A recloseable container as in claim 7 wherein said dispensing means and said hinged closure means have cooperating liquid seal means.

14. A recloseable container as in claim 13 wherein said cooperating liquid seal means comprises an interfitting rib and groove arrangement.

15. A reclosable container comprising a container body, a planar border at least partially surrounding said container body, said container body sealed at one end and having an openable dispensing means at another end; a first breakaway means disposed above said dispensing means and closing said dispensing means; a hinged closure means laterally adjacent said dispensing means and attached to said container body by a hinge, said hinged closure means rotating on said hinge to overlap and reclose said dispensing means, said hinged closure means having a locking means to lock said hinged closure means, a cooperating locking means on said planar border, whereby said hinged closure means secures said dispensing means after said first breakaway means has been removed.

16. A recloseable container as in claim 15 wherein said border locking means and said hinged closure locking means comprise a mating pin and aperture.

17. A reclosable container comprising a thermoformed container having a container body, said container body sealed at one end and having an openable dispensing means at another end; a first breakaway means disposed above said dispensing means and closing said dispensing means; a hinged closure means laterally and sidewise adjacent said dispensing means and attached to said container body by a hinge, said hinged closure means is able to be rotated on said hinge to overlap and reclose said dispensing means after said first breakaway means has been removed, a second breakaway means on a lower end of said hinged closure means and attaching said hinged closure means to said planar border whereby said hinged closure means cannot be rotated on said hinge until said second breakaway means is severed.

* * * * *